US006279426B1

(12) United States Patent
Neves

(10) Patent No.: US 6,279,426 B1
(45) Date of Patent: Aug. 28, 2001

(54) POWER TONG WITH IMPROVED DOOR LATCH

(75) Inventor: Billy W. Neves, Odessa, TX (US)

(73) Assignee: Eckel Manufacturing Company, Inc., Odessa, TX (US)

( * ) Notice: Subject to any disclaimer, the term of this patent is extended or adjusted under 35 U.S.C. 154(b) by 0 days.

(21) Appl. No.: 09/560,919

(22) Filed: Apr. 28, 2000

(51) Int. Cl.[7] ..... B25B 17/00
(52) U.S. Cl. ..... 81/57.15; 81/57.18; 81/57.33
(58) Field of Search ..... 81/57.33, 57.34, 81/57.14–57.21

(56) References Cited

U.S. PATENT DOCUMENTS

| | | | | |
|---|---|---|---|---|
| 4,266,450 | * | 5/1981 | Farr et al. | 81/57.33 |
| 4,574,664 | | 3/1986 | Curry | 81/57.34 |
| 4,593,584 | | 6/1986 | Neves | 81/57.18 |
| 4,649,778 | * | 3/1987 | Bottoms | 81/57.33 |
| 5,144,868 | * | 9/1992 | Feigel, Jr. | 81/57.15 |
| 5,535,645 | * | 7/1996 | Penisson | 81/57.33 |
| 6,058,811 | | 5/2000 | Stuart | 81/57.15 |

FOREIGN PATENT DOCUMENTS

| | | | | |
|---|---|---|---|---|
| 1088918-A | * | 11/1980 | (CA) | 81/57.15 |

* cited by examiner

*Primary Examiner*—Joseph J. Hail, III
*Assistant Examiner*—David B. Thomas
(74) *Attorney, Agent, or Firm*—Browning Bushman

(57) ABSTRACT

An open throat power tong 10 for making up and/or breaking apart an oilfield tubular connection includes an open throat in the tong body 15. Motors 18, 20 rotate a partial ring member 12 and a pair of heads 16 with respect to the tong body. A door 40, 140 may be opened to expose the open throat of the power tong, and has a planar latch surface formed from arcuate groove 58 for receiving an arcuate boss 90. The door latch mechanism reduces the effort required to safely latch the door in the closed position before operating the tong, and provides a highly reliable mechanism to minimize spreading of the tong body under a relatively high torque.

20 Claims, 4 Drawing Sheets

POWER TONG WITH IMPROVED DOOR LATCH

FIELD OF THE INVENTION

The present invention relates to power tongs of the type commonly used to make up and break apart oilfield tubular threaded connections. More particularly, this invention relates to an improved open throat power tong which may be laterally moved on and off a tubular string, and to an improved door mechanism for such a power tong which will extend across the open throat when in the closed position and will expose the open throat when in the opened position.

BACKGROUND OF THE INVENTION

Power tongs have been used for decades to make up and break apart oilfield tubular connections. While such power tongs have a variety of configurations and different mechanisms are used to both grip and rotate an upper tubular relative to a lower tubular, such power tongs generally may be classified as being either the closed throat type or the open throat type. Closed throat power tongs provide a tong body which fully encircles the tubular string, so that repeated oilfield threaded connections pass axially through an opening in the closed throat power tong. The body of an open throat power tong, on the other hand, will typically encircle the majority of the oilfield tubular connection, but an open throat is provided in the tong body and also in the rotary ring which rotates within the tong body to allow the tong to be laterally moved on and off the tubular string. Most open throat power tongs are provided with a door which accordingly is opened to expose the open throat of the power tong when the tong is not being operated. The door of a power tong is closed when the power tong is operated to prevent a tong operator from inadvertently engaging the rotating ring, and also to increase the reliable torque output of the power tong by preventing "spreading" of the open throat. In many oilfield operations, open throat power tongs which provide a door pivotally connected to the tong body are highly preferred over closed throat power tongs.

Various types of latching mechanisms have been used in the power tong industry to retain the pivotal door in the closed position. The commonly used latching mechanism in an open throat power tong employs a heavy duty hammer latch mechanism which includes a latch arm pivotally connected to one of the pair of doors positioned on opposing sides of the open throat. Alternatively, a single door may extend across the open throat, so that the latch arm on the door engages a lug on the tong body. In either case, a latch head at the end of the latch arm engages a latch lug or stop to retain the door or the pair of doors in the closed position. The latch head and the latch lug typically have planar surfaces which engage when the door or the pair of doors are in the closed position. The heavy duty latch mechanism and door are sufficient to withstand a substantial lateral force, and thus minimize spreading of the open throat of the power tong. To open the doors, the operator manually grasps a handle secured to the latch arm and pulls the latch arm away from the latch stop to disengage the mating surfaces. With the door or doors opened, a power tong may then be moved laterally on and off a tubular string.

When the open throat power tong is positioned about the tubular string and prior to activating the partial ring, the door with the latch stop is first closed, then the door with the latch arm is manually closed. The latch arm conventionally includes a spring member which biases the latch arm to the closed position relative to its supporting door. By applying a considerable closing force to the door supporting the latch arm, a cam surface on a latch head engages a corresponding cam surface on the latch stop which causes the latch arm to pivot toward an opened position while the latch head moves radially outward from the latch stop. Once the latch arm is pivotally moved to the opened position, the latch head moves radially inward relative to the latch stop so that the planar surfaces on the latch head and the latch stop engage. The spring on the latch arm serves to provide additional force which retains the doors closed.

A significant disadvantage of the power tong door mechanism discussed above is that it requires a large amount of closing force to shut the doors while the latch head moves radially outward with respect to the latch stop, so that the latch head will then be properly positioned so that it may move back radially inward relative to the latch stop and secure the doors closed. This large closing force requires that the door mechanism components be sized both for withstanding the spreading force discussed above, and also to ensure that components are sufficiently rugged to withstand the repeated substantially jarring force which these components endure during closing of the door. A related drawback of this prior art system is that a great deal of effort is required by a tong operator to close the door, which unfortunately increases the tendency for the operator to merely position the door in the partially closed position and not fully latch the door closed. Failure to latch the door closed creates a safety risk, as discussed above, and may also result in tong spreading when high torque is used to make up or break apart the threaded connection. Moreover, it is often difficult for the tong operator to apply the necessary force to close the door under situations where the tong is not at a comfortable working level of, for example, four feet above the rig floor. In some cases, the tong may be positioned six feet above the rig floor and, in those situations, it is difficult for the tong operator to apply a sufficient force to reliably close the tong door.

Another significant drawback of prior art power tong door latch mechanisms is the complexity of the latch mechanism. Various door latch mechanisms have numerous moving parts, including for example biasing springs and other members that may fail. The failure of one of these parts can adversely affect the safety of the door latch mechanism, and a simple yet reliable door latch mechanisms for power tongs has long been desired. One simplistic prior art door latch mechanism included an upwardly projecting stud and a downwardly projecting stud each welded to the top plate and bottom plate of the tong. Each large diameter short stud thus had an axis which ideally was parallel to the axis of the rotary gear. The door included a hook having a generally U-shaped slot therein, with the slot being sized to fit between the diameter of each stud when the door was closed. While simplistic, this design did not significantly reduce spreading since there was essentially line contact or very small area planar contact between the side of the cylindrical stud and the engaging side wall of the hook.

The disadvantages of the prior art are overcome by the present invention. An improved open throat power tong and a door mechanism for such a power tong is hereinafter disclosed. The door mechanism of the present invention significantly reduces or eliminates the amount of force required by the operator to reliably latch the door in the closed position, and the door latch mechanism is efficient and simplistic in operation and use.

SUMMARY OF THE INVENTION

An open throat power tong for making up and/or breaking apart an oilfield tubular connection comprises a tong body having an open throat therein, a partial ring member rotatably supported on the tong body for rotating one tubular relative to another during a make up and/or break out operation, at least two heads rotatable with the partial ring for gripping engagement with the upper oilfield tubular, and a drive motor for powering rotation of the partial ring. A door pivotally connected to the tong body adjacent a side of the open throat extends at least partially across the open throat when in the closed position, and when in the open position exposes the open throat to enable the power tong to be moved laterally on and off the oilfield tubular.

In a preferred embodiment, the door comprises a top door plate and a bottom door plate each having an arcuate groove therein, a center door plate which structurally interconnects the top and bottom door plates, a handle secured to the center plate, and a top door bearing housing and a bottom door bearing housing fixed to the respective top door plate and bottom door plate. A top door boss and bottom door boss are each rigidly secured to a top plate and bottom plate of the tong body. When the door is moved to the closed position, both the top door boss and the bottom door boss are received within the arcuate groove in the top door plate and the bottom door plate. A relatively large area of planar engagement is thus provided between each door boss and the respective door plate to minimize spreading of the tong body when subject to high torque.

The open throat power tong improves safety by reducing or eliminating the effort required by the operator to safely latch the door in the closed position before operating the tong. Closing of the door requires very little manual effort, thereby reducing fatigue to the tong operator.

It is an object of the present invention to provide an improved open throat power tong with an improved door mechanism which will reliably latch the door in the closed position, and which reduces the force and thus the tong operator effort required to reliably close the door.

A related object of the invention is to improve the safety of an open throat power tong by increasing the likelihood that the operator will reliably latch the door of the power tong closed before operating the power tong.

It is a feature of the present invention that a relatively large area is provided in the latch mechanism for retaining the door in the closed position for minimizing spreading of the tong body under a relatively high torque. The application of high torque to the power tong will cause each door boss to engage the door with a force that practically eliminates any possibility of the door being opened while high torque is applied to the tong.

Another feature of the invention is that the door latch mechanism and the power tong may include a single door which extends across the open throat of the power tong body, or may include a pair of doors each pivotally connected to the tong body on opposing sides of the open throat of a power tong, with one of the doors containing the arcuate grooves of the other door containing the mating door bosses.

Still another feature of the invention is that no biasing mechanism is required to latch the door in the closed position and maintain the door in that position with high torque applied to the power tong.

An advantage of the present invention is that the fatigue on the operator is reduced by significantly reducing the effort required to latch the door in the closed position.

Yet another advantage of the invention is that the door mechanism is highly reliable and may be inexpensively manufactured.

These and further objects, features, and advantages of the present invention will become apparent from the following detailed description, wherein reference is made to figures in the accompanying drawings.

DETAILED DESCRIPTION OF PREFERRED EMBODIMENTS

Figure 1:
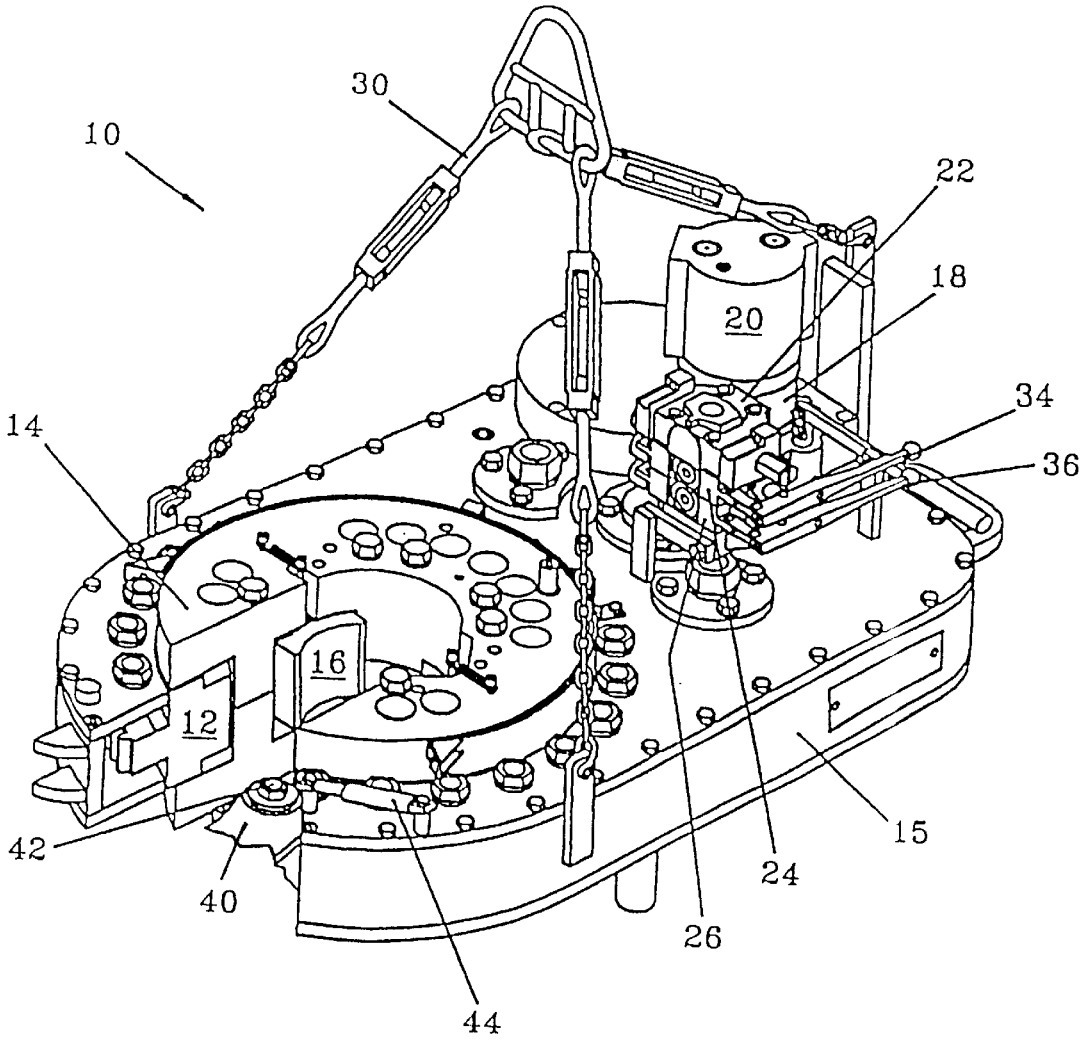
FIG. 1 generally depicts a power tong according to one embodiment of the present invention, with a majority of the fully opened door removed.

FIG. 1 depicts one embodiment of a power tong 10 suitable for making up and/or breaking apart threaded tubular members, such as drill pipe, casing, or tubing. The power tong 10 is of the open throat type, with a partial ring member 12 and a cage plate assembly 14 both including open throat portions so that when these open throats are aligned as shown in FIG. 1, the tong may be laterally moved on and off a string of pipe. The hydraulic motors 18, 20 or other tong drive mechanism act to rotate the ring 12 relative to the cage plate 14, causing two or more dies 16 to come into gripping engagement with the pipe. Thereafter, both the partial ring 12 and cage plate 14 may be rotated together relative to the tong body or frame 15 to rotate or thread an upper pipe relative to a lower pipe.

Motors 18 and 20 may be powered by a skid-mounted hydraulic unit (not depicted) which supplies pressurized hydraulic fluid to the tong through conduit. Fluid is returned via another line to a tank (not shown) associated with the hydraulic unit. Hydraulic fluid may be directed to the motors through valve block 22, which includes valve assembly 24 for controlling fluid flow to the medium speed motor 18, and valve assembly 26 hydraulically in parallel with valve assembly 24 for controlling fluid flow to the high speed motor 20. Valve assembly 24 may be actuated by horizontal control handle 34, and valve assembly 26 may be actuated by vertical control handle 36. Representative flexible flowlines may be provided from the valves to their respective motors, as well as a representative gauge (not shown) for monitoring the fluid pressure to either or both of the motors. An adjustable suspension mechanism 30 is provided for supporting the tong body 15.

The open throat tong 10 is shown in FIG. 1 with only a portion of a single door 40 in the opened position. Door 40 is pivotally connected at 42 to the rigid body 15 of the tong adjacent the right-side of the open throat. When properly locked, the door acts to prevent "spreading" of the tong in the area of the open throat 17 under high make-up or break-out torques. A powered door closure optionally may be provided, and hydraulic cylinder 44 is shown between the tong body and the door 40 for that purpose. It should be understood that a similar powered door opening and closing cylinder (not shown) may be provided if both a right-side and a left-side door close over the open throat 17, as discussed subsequently. Alternatively, the door or pair of doors extending across the open throat 17 may be manually opened and closed by a tong operator, as discussed subsequently.

Figure 2:
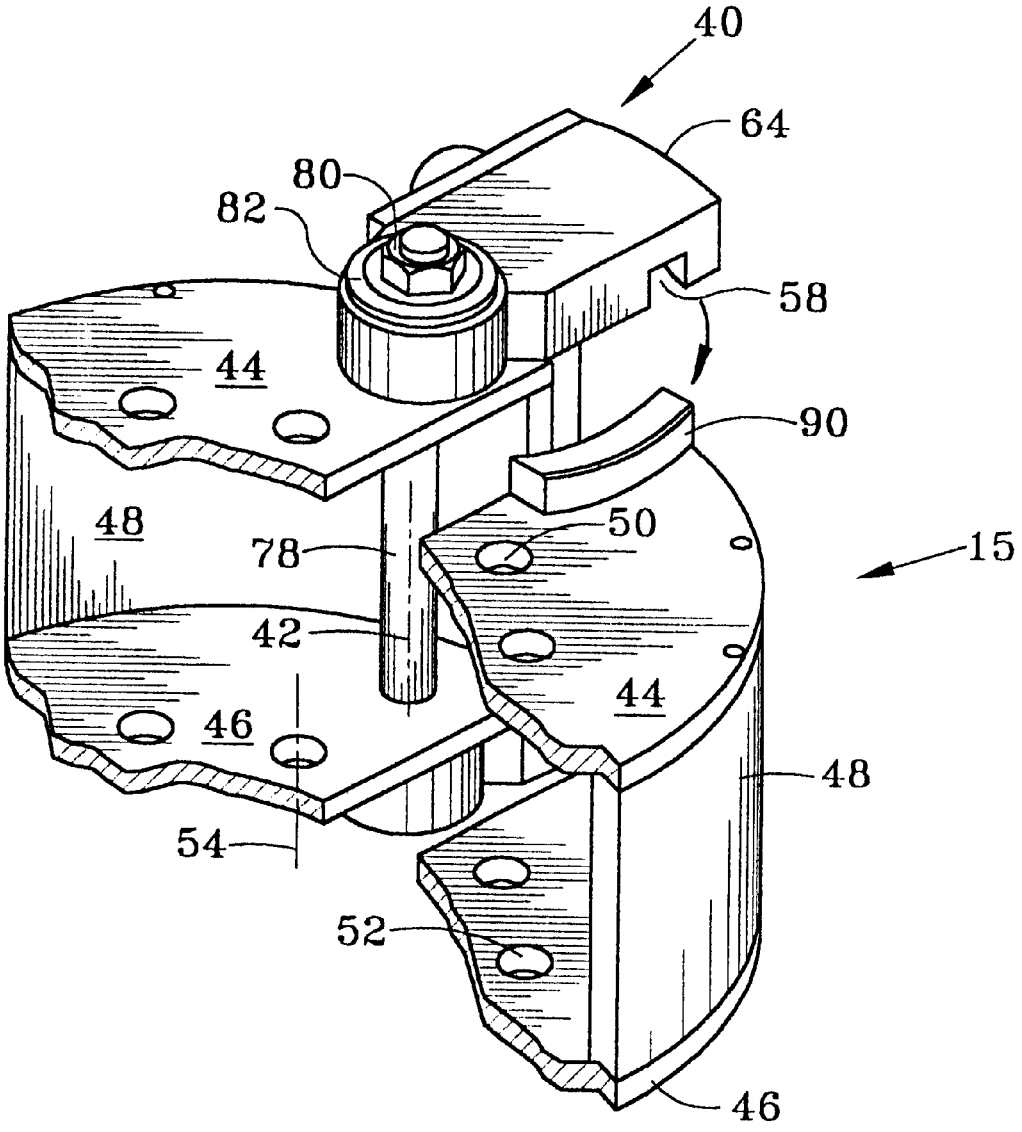
FIG. 2 is a pictorial view of a portion of power tong shown in FIG. 1, with the dumbbell rollers for guiding the partial ring removed and the door shown in the opened position.

Referring now to FIG. 2, a representative tong body 15 may include a top plate 44, a bottom plate 46, and a side plate 48. The top plate 44 may be provided with a plurality of holes 50, and a bottom plate 46 provided with similar aligned holes 52 for positioning a "dumbbell" rollers within the tong body for guiding rotational movement of the partial ring member 12 during the makeup or breakout operation. Those skilled in the art recognize that, during high torque operations, the open throat of the tong body undesirably tends to spread apart. To minimize this spreading and for safety purposes, the door 40 as shown in FIG. 2 may be pivotally connected to the tong body. Most importantly, the door 40 hinged to the tong body and the boss 90 welded to the tong body may be used to reliably latch the door in the closed position, as explained subsequently.

Figure 3:
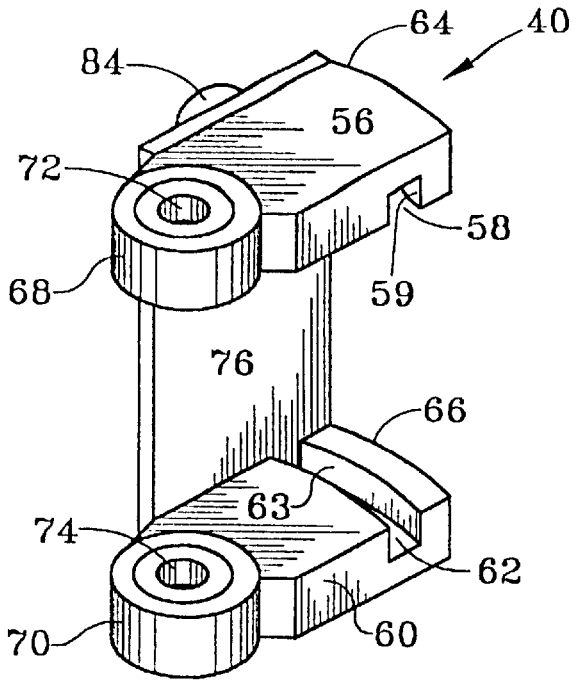
FIG. 3 is a pictorial view of the door as shown in FIG. 2.
Figure 4:
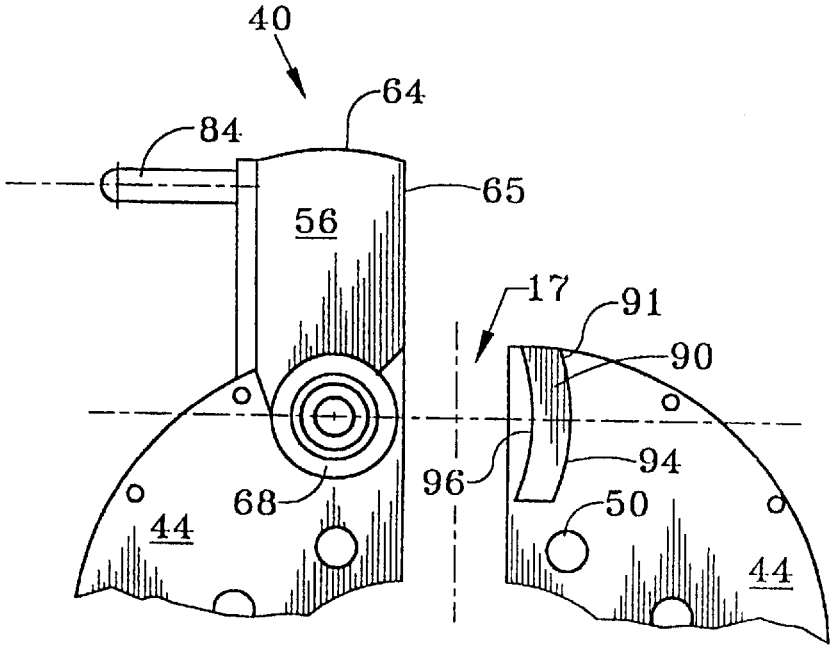
FIG. 4 is top view of a portion of a power tong and door shown in FIG. 2.

The door 40 is shown in greater detail in FIG. 3, and may include a top door plate 56 and bottom doorplate 60. The top doorplate 56 includes an arcuate groove 58, and the bottom door plate 60 includes a similar arcuate groove 62. The door 40 further includes an intermediate plate 76 which structurally interconnects the top plate 56 and the bottom plate 60. A bearing housing 68 having a throughbore 72 is also affixed to a side of the top plate 56 opposite the curved surface 64. A similar bearing housing 70 with a throughbore 74 is affixed to the bottom plate 60. The axes of the throughbores 72 and 74 are aligned and sized to receive rod 78, as shown in FIG. 2. The throughbores 72, 74 and the rod 78 are thus each aligned with the central door pivot axis 42. The handle 84 as shown in FIGS. 3 and 4 may be welded to the intermediate plate 76. The door 40 as shown in FIG. 3 may be fabricated by a variety of techniques, including machining of the plates 56 and 60 to include the arcuate grooves therein, and welding of the intermediate plate 76 and the bearing housings 68, 70 to the respective plates 56, 60. The handle 84 may then be welded to any of the plates 56, 60 or 76. Various other techniques may be used, including for example, casting the top and bottom plates to a bearing housing or casting other components as a single piece.

Referring again to FIG. 1, the arcuate elongate boss 70 preferably has a substantially rectangular configuration, and may be welded to the top plate 44 of the tong body 15. During assembly of the power tong, the door 40 may be pivotally connected to the tong body, the door closed, and marks placed on the top surface of the tong body plate 44 to properly locate arcuate boss 90 with respect to the tong body.

Figure 5:
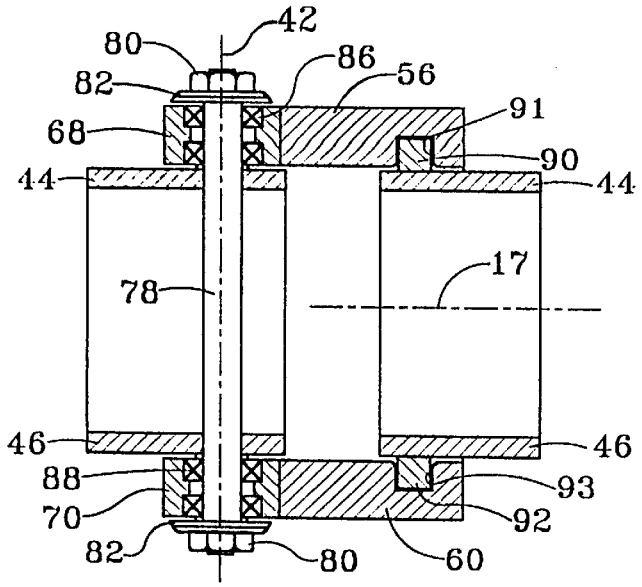
FIG. 5 is a cross-sectional view along line 5—5 in FIG. 4, with the door in a closed position.

As indicated above, the door 40 may be pivotally mounted to the tong body by conventional techniques. In a preferred embodiment, the door is sized so that the top plate 56 slides over the top plate 44 of the tong body, and the bottom plate 60 slides under the bottom plate 46 of the tong body. The doors pivot about axis 42, and conventional bearing assemblies minimizing friction and thus the effort required to open or close the door. Referring to FIG. 5, a simplistic upper bearing 86 and a lower bearing 88 are shown within the bearing housings 68 and 70. The top washer 82 may be provided for engagement with tensioning nut 80 which is threadably connected to the shaft 78. A similar washer 82 tension nut 80 may be provided on the lower end of the shaft 78, as shown in FIG. 5. The surface 65 of the door 40 thus becomes the radially inward surface of a closed door with respect to a central axis of the partial ring 12.

Referring now to FIGS. 3 and 4, it should be understood that during closing of the door, the top arcuate boss 90 and the bottom arcuate boss 92 are received within the correspondingly shaped slots 58 and 62 and the door 40. The arcuate groove in the top plate 56 thus opens downward, and the arcuate groove 62 opens upward, as shown in FIG. 3. Due to a slight gap between the components, the door may be closed with minimal or no interference between the door and the bosses although, during makeup of the threaded connection, interference of these components effectively locks the door in the closed position and minimizes spreading of the open throat 17 of the power tong. The slot 58 thus defines the curved planar latch surface 59, while the groove 62 defines a similar curved planar latch surface 63. Referring to FIGS. 3, 4, and 5, minimal spreading of the open throat 17 of the tong body will cause the planar latch surfaces 59, 63 to come into planar engagement with the corresponding planar boss surfaces 91, 93 and the bosses 90, 92. Preferably each of the surfaces 59, 63, 91, 93 is thus a curved planar surface, with the curve of the plane being substantially along the pivot axis 42.

Referring to FIG. 3, door 40 may include a conventional handle 84. As explained above, the powered actuator such as the cylinder assembly 44 as shown in FIG. 1 may also be used to open and close the door.

By providing planar engagement of surfaces to minimize spreading, with each surface having a center lying substantially along the pivot axis 42, minimal spreading of the open throat 17 may occur before the surfaces engage, and thereafter the substantial planar engagement of the surfaces on the door and the arcuate bosses 90, 92 minimize further spreading of the open throat. This engagement is preferably provided at a location both above and below the conventionally horizontal plane 17 of the tong body to minimize bending forces which would occur if only a single arcuate boss spaced above or below the tong body centerline 17 were employed. Also, the arcuate bosses are preferably affixed by welding to the upper tong body plate 44 and the lower tong body plate 46, respectively, to both provide the desired strength to minimize spreading and to allow the arcuate bosses to be easily replaced if worn or damaged.

Figure 6:
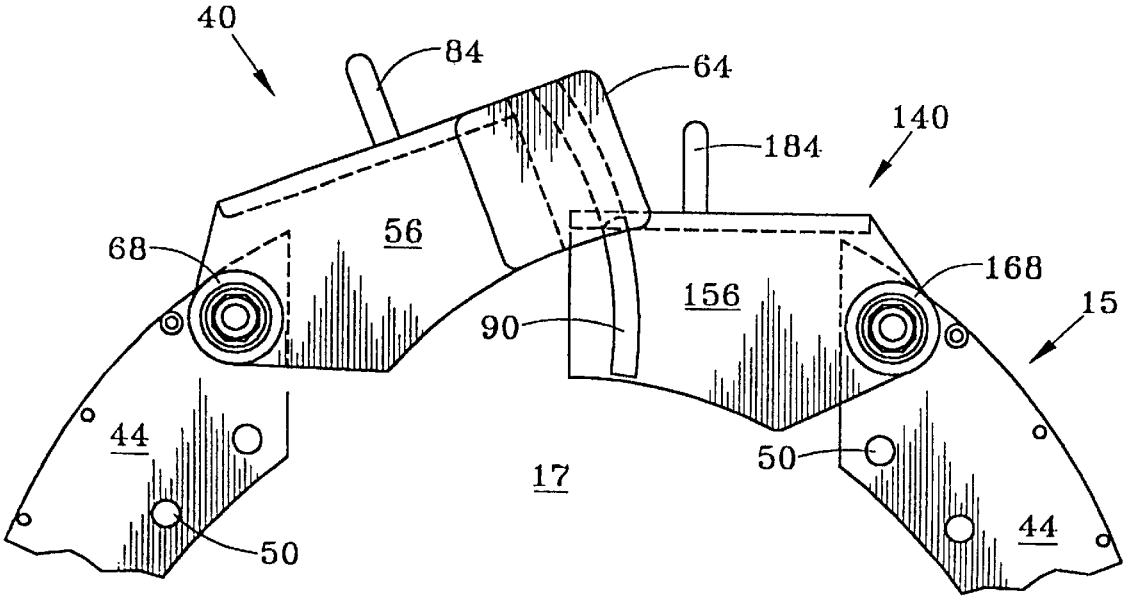
FIG. 6 is a top view of a portion of a power tong and two doors in the partially closed position and a door latch mechanism according to the present invention.

FIG. 6 depicts a top view of an alternate embodiment of a power tong with an improved door latch mechanism according to the present invention. The power tong thus includes both a right side door and a left side door. The same numerical references are used in the FIG. 6 embodiment for components having the function discussed above. Those skilled in the art will appreciate that in this alternate embodiment, the components of the power tong other than the door may remain substantially as shown in FIG. 1.

The tong body 15 thus includes a upper tong body plate 44 which contains the holes 50 for the dumbbell rollers, as discussed above. The right side door 40 includes a door bearing housing 68, while the left side door 140 includes a similar bearing housing 168. During closing of the doors, the operator may first close the left side door utilizing the handle 184 so that the left side door 140 is fully closed as shown in FIG. 17. The top arcuate boss 90 is thus welded to the door 140 and, once the left side door 140 is closed, serves the same purpose as the boss previously described.

Once the left side door 140 is closed, the right side door 40 may then be closed, with the arcuate groove 58 being sized to receive the boss 90. When fully closed, the doors 40, 140 resist spreading in the same manner as the single door 40 discussed above. Those skilled in the art will appreciate that, once the connection is made up, the right side door 40 may first be opened, the left side door 140 opened so that the tong may be laterally moved off the connection and subsequently moved laterally to make up a new connection. Although not depicted, those skilled in the art will understand that the assembly as shown in FIG. 6 also includes a lower arcuate boss 92 welded to the door 140 for receipt within a lower groove 62 in the door 40. The boss 68 is thus secured to the top plate 56 at a location opposite the end surface 64. The boss 168 as shown in FIG. 6 is thus similarly positioned opposite the end surface 164 of the top door plate 156 of the door 140. The door latch mechanism and the doors may thus otherwise include the components discussed above.

In each of the embodiments, the doors may be sized and mounted to the tong body such that the doors do not limit the size of the tubular that otherwise may pass through the throat 17 and thus into the center of the partial ring 12. When it is desired to move the tong back on to the tubular string (typically to make up or break apart another threaded connection), the tong may simply be moved so that the tubular string is radially within the partial ring and the cage plate assembly, during which operation the door 40 is opened. When a pair of doors are provided each extending partially across the open throat 17 of the tong body, each of the doors has a closing face which, when the doors are closed, is spaced substantially centrally within the open throat 17 of the tong body.

By maintaining the desired curvature of the engaging surfaces 59 and 91 (and 63 and 93) within the desired tolerance and positioning with respect to the pivot axis of the door, a minimal spreading of the tong body may occur before these planar surfaces engage, and thereafter the substantial a real engagement of these planar surfaces minimizes spreading. With these high forces, the door could not be manually opened under normal circumstances when high torque was applied by the power tong. According to the present invention, the initial gap between the surfaces 59 and 91 (and between 63 and 93), is less than twenty thousandths inch for most power tongs, and preferably a gap of less than fifteen thousandths may be maintained. For a relatively small tong, a gap of ten thousandths or less may thus be obtained.

According to a preferred embodiment, a very slight gap is also maintained between the radially inner surface of each boss and the radially inner surface of the corresponding groove. Also, each of these planar arcuate inner surfaces also preferably has a center lying substantially along the pivot axis. Since the forces tending to cause spreading of the open throat of the tong body are complex, in many applications only a portion of the outer surface of the boss engages a portion of the outer groove surface. In these cases, engagement of a portion of the inner surface of the boss and the inner surface of the groove thus assists in minimizing spreading.

The door may thus be closed with no interference of surfaces. Once a nominal torque is applied by the power tong, spreading may cause these planar surfaces to engage, and the application of further torque to the power tong will securely engage these surfaces while desirably minimizing spreading of the open throat of the tong body. After the connection is made up and the torque is released from the connection, the door may be opened again without any interference the door and the boss.

Those skilled in the art should appreciate that the boss as disclosed herein preferably has a rectangular configuration, but may be otherwise conformed. For example, a arcuate boss with triangular cross sectional configuration can be provided, provided that the "back surface" on the boss was a planar surface and was at least substantially parallel with the pivot axis of the door. Similarly, a groove is not required in order to provide the planar surfaces 59, 63 on the door, although only the "back surface" of the groove is functional as a latch surface on the door for planar engagement with the boss surface on the arcuate boss. Also, if the slot were not provided in the top plate and bottom plate of the door or a very wide slot were provided on the door, the boss could have other configurations, although the boss would still have a planar boss surface for planar engagement with the planar latch surface.

Although a power tong as discussed above is of the type provided with two heads for engaging the oilfield tubular, a power tong according to the present invention may include a third or additional heads. A third head is provided, the head could be mounted on the door. Although the drive motor for powering rotation of the partial ring may be various types of motors, the tong is preferably hydraulically powered and thus is provided with a hydraulic drive motor. The tong according to the present invention may include various safety mechanisms for insuring that the door is closed before the drive motor is activated.

The door mechanism of the present invention is ideally suited for retrofitting an existing power tong having a conventional door mechanism with the improved door latch mechanism of the present invention. It should also be understood, however, that an improved power tong according to the present invention may be initially manufactured with a tong body having an open throat, a partial ring member rotatably supported on the tong body, at least two heads rotatable with the partial ring, a drive motor for powering rotation of the partial ring, and the door mechanism as discussed herein for latching the door in the closed and latched position. A significant benefit to such power tong is the reduced effort required by the tong operator to close the door of the open throat power tong, which thereby increases the tendency of the tong operator to properly latch the door closed and thereby minimize both the safety risk and tong spreading.

The door mechanism of the present invention is particularly well suited for extending at least partially across the open throat of a power tong, but may also be used in other oilfield applications for equipment having open throats therein. For example, the door of the present invention may be used to extend across the open throat of a backup tong which may not include a partial ring member or a drive motor for powering rotation of the partial ring. Many types of backup tongs have open throats, and in such tongs a door may be provided for closing across the open throat to minimize the safety risk to the tong operator. The door mechanism of the present invention may also be used with other oilfield tools or equipment. Elevators are exemplary of other equipment which may have an open throat and which may benefit from the improved door mechanism in the present invention.

Those skilled in the art will appreciate that a substantially wider gap may be provided between the radially inward surface of groove.

Although particular embodiments of the apparatus of the invention and the method of practicing the invention have been shown and described herein, it should be apparent that various changes and modifications may be made without departing from the broader aspects of the invention. Accordingly, the purpose of the following claims is to cover such changes and modifications that fall within the spirit and scope of the invention.

what is claimed is:

1. An open throat power tong for making up and/or breaking apart an oilfield tubular connection, comprising:

a tong body having an open throat therein;

a partial ring member rotatably supported by the tong body for rotating a tubular during a makeup and/or break out operation;

at least two heads rotatable with the partial ring for gripping engagement with the oilfield tubular connection;

a drive motor for powering rotation of the partial ring;

a door pivotally connected to the tong body adjacent a side of the open throat to extend at least partially across the open throat when in the closed position and to expose the open throat of the power tong when in the opened position to enable the power tong to be moved laterally on or off a tubular string;

the door rotatable about a door pivot axis with respect to the tong body and having a planar latch surface, the planar latch surface having a latch center positioned substantially along the door pivot axis; and a boss secured to the tong body, the boss having an arcuate planar boss surface for planar engagement with the planar latch surface, the boss surface having a boss center positioned substantially along the door pivot axis.

2. The open throat power tong as defined in claim 1, wherein each of the planar latch surface and planar boss surface are parallel to the door pivot axis.

3. The open throat power tong as defined in claim 1, wherein the door includes a top plate having a top plate arcuate groove therein defining a top planar latch surface and a bottom plate having a bottom plate arcuate groove therein defining a bottom planar latch surface, and wherein the boss includes a top boss having a top planar boss surface for receipt within the top plate arcuate groove and a bottom boss having a bottom planar boss surface for receipt within the bottom plate arcuate groove.

4. An open throat power tong as defined in claim 3, wherein the top plate arcuate groove opens downward and the bottom plate arcuate groove opens upward, and wherein the top boss is fixed to a top surface of the tong body upper plate and the bottom boss is affixed to a lower surface of a tong body lower plate.

5. The open throat power tong as defined in claim 3, further comprising:

an intermediate plate fixedly secured to the top plate and the bottom door plate; and a top bearing housing fixed to the top door plate and bottom bearing housing fixed to the bottom door plate.

6. The open throat power tong as defined in claim 1, wherein the boss has a substantially rectangular cross sectional configuration.

7. The open throat power tong as defined in claim 1, wherein the boss is welded to the tong body.

8. The open throat power tong as defined in claim 1, further comprising:

another door pivotally connected to the tong body at an opposing side of the open throat of the power ton, the another door supporting the boss thereon; and the door having a door closing face, the another door having another door closing face, and the door closing face and the another closing face each being spaced substantially centrally within the open throat of the tong body when the door and the another door are closed.

9. The open throat power tong as defined in claim 1, further comprising:

a powered operator supported on the tong body for opening and closing the door.

10. A door mechanism for a power tong having a tong body with an open throat therein, the door mechanism, comprising:

a door pivotally connected to the tong body adjacent a side of the opened throat to extend at least partially across the open throat when in the closed position and to expose the open throat of the power tong when in the opened position to enable the power tong to be moved laterally on or off a tubular string;

the door rotatable about a door pivot axis with respect to the tong body and having planar latch surface, the planar latch surface having a latch center positioned substantially along the door pivot axis; and a boss secured to the tong body, the boss having an arcuate planar boss surface for planar engagement with the planar latch surface, the boss surface having a boss center positioned substantially along the door pivot axis.

11. The door mechanism as defined in claim 10, wherein each of the planar latch surface and planar boss surface are parallel to the door pivot axis.

12. The door mechanism as defined in claim 10, further comprising:

another door pivotally connected to the tong body at an opposing side of the open throat of the power tong, the another door supporting the arcuate boss thereon.

13. The door mechanism as defined in claim 12, further comprising:

the door having a door closing face, the another door having another door closing face, and the door closing face and the another closing face each being spaced substantially centrally within the open throat of the tong body when the door and the another door are closed.

14. The door mechanism as defined in claim 10, wherein the door includes a top plate having a top plate arcuate groove therein defining a top planar latch surface and a bottom plate having a bottom plate arcuate groove therein defining a bottom planar latch surface, and wherein the boss includes a top boss having a top planar boss surface for receipt within the top plate arcuate groove and a bottom boss having a bottom planar boss surface for receipt within the bottom plate arcuate groove.

15. The door mechanism as defined in claim 14, wherein the top plate arcuate groove opens downward and the bottom plate arcuate groove opens upward, and wherein the top boss is fixed to a top surface of the tong body upper plate and the bottom boss is affixed to a lower surface of a tong body lower plate.

16. The door mechanism as defined in claim 10, wherein the boss has a substantially rectangular cross sectional configuration.

17. An open throat power tong for making up and/or breaking apart an oilfield tubular connection, comprising:

a tong body having an open throat therein;

a partial ring member rotatably supported by the tong body for rotating a tubular during a makeup and/or break out operation;

at least two heads rotatable with the partial ring for gripping engagement with the oilfield tubular connection;

a drive motor for powering rotation of the partial ring;

a door pivotally connected to the tong body adjacent a side of the open throat to extend at least partially across the open throat when in the closed position and to expose the open throat of the power tong when in the opened position to enable the power tong to be moved laterally on or off a tubular string;

the door rotatable about a door pivot axis with respect to the tong body and having an arcuate groove therein defining a planar latch surface substantially parallel to the door pivot axis and a latch center positioned substantially along the door pivot axis; and a boss secured to the tong body, the boss having an arcuate planar boss surface for planar engagement with the planar latch surface, the planar boss surface being substantially parallel to the door pivot axis and having a boss center positioned substantially along the door pivot axis.

18. The open throat power tong as defined in claim 17, wherein the door includes a top plate having a top plate arcuate groove therein defining a top planar latch surface and a bottom plate having a bottom plate arcuate groove therein defining a bottom planar latch surface, and wherein the boss includes a top boss having a top planar boss surface for receipt within the top plate arcuate groove and a bottom boss having a bottom planar boss surface for receipt within the bottom plate arcuate groove.

19. The open throat power tong as defined in claim 18, further comprising:

an intermediate plate fixedly secured to the top plate and the bottom door plate; and a top bearing housing fixed to the top door plate and bottom bearing housing fixed to the bottom door plate.

20. The open throat power tong as defined in claim 17, further comprising:

another door pivotally connected to the tong body at an opposing side of the open throat of the power tong, the another door supporting the boss thereon; and the door having a door closing face, the another door having another door closing face, and the door closing face and the another closing face each being spaced substantially centrally within the open throat of the tong body when the door and the another door are closed.

* * * * *